United States Patent [19]

Freimuth et al.

[11] 4,108,221

[45] Aug. 22, 1978

[54] CONTAINER FILLING MACHINE

[75] Inventors: Gerhart William Freimuth, Flemington; Jerold Samuel Weiner, Spotswood, both of N.J.

[73] Assignee: Gerhart Engineering & Machine Co., Somerville, N.J.

[21] Appl. No.: 712,054

[22] Filed: Aug. 6, 1976

[51] Int. Cl.[2] ..... B65B 3/32

[52] U.S. Cl. ..... 141/146; 92/13.7; 141/152; 222/168.5; 222/309

[58] Field of Search ..... 92/13.2, 13.7; 74/41, 74/600; 222/168.5, 205, 306, 309, 366, 387, 444; 141/1, 115–117, 126, 127, 138–152, 172, 177, 183, 188, 191, 263, 275–278, 367, 376, 378

[56] References Cited

U.S. PATENT DOCUMENTS

| | | | |
|---|---|---|---|
| 2,086,890 | 7/1937 | Ashlack et al. | 141/142 |
| 3,580,302 | 5/1971 | Riesenberg | 141/152 X |
| 3,825,043 | 7/1974 | Fechheimer | 141/152 X |

*Primary Examiner*—Richard E. Aegerter
*Assistant Examiner*—Frederick R. Schmidt
*Attorney, Agent, or Firm*—Kenneth Watov

[57] ABSTRACT

A container filling machine comprises a plurality of filling stations each including a container platform which is raised and lowered by a cam controlled elevating mechanism, for providing bottom-up filling; a cam-controlled pumping mechanism operating a piston pump for drawing fluid into the pump during a charge cycle, and pushing the fluid out of the pump during a discharge cycle; and an adjustable crank lever mechanism is included in the cam controlled pumping mechanism for providing adjustment of the volume of fluid being pumped. Operating in common with the filling stations are a pair of cams for operating the valves of each station, and in combination with each cam-controlled pumping mechanism provide greater than 180° of machine time for continuously filling a container during the discharge cycle for each station. A rotary bearing upon nuts mounted on a plurality of jackscrews support the filling stations, whereby the jackscrews are turned in unision via a chain for raising and lowering the filling stations but not their container platforms, for adjusting to different heights of containers. The profile of the track for the cam of the cam controlled pumping mechanism can be changed to program the exit velocity of the fluid in accordance with the viscosity of the fluid.

12 Claims, 20 Drawing Figures

FIG. 4
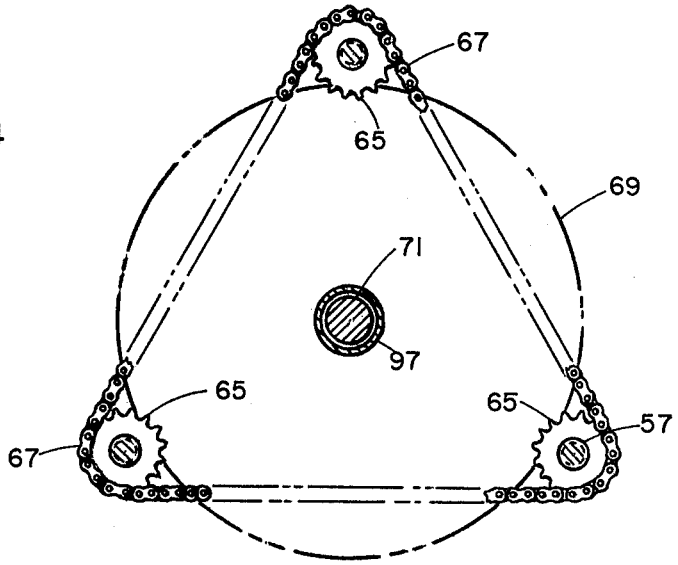
FIG. 5
A
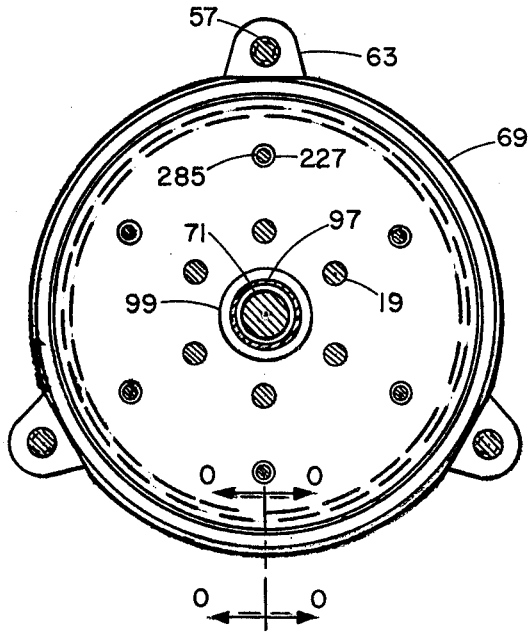
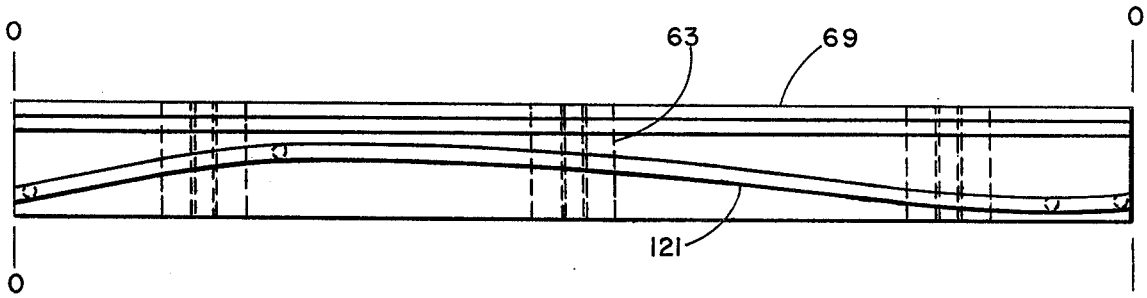
FIG. 5
B 105
91
71
97
103
99
93
7
105
101
91
95
71
109
145
7
91
143
157
19
153
155
143
147
141
149
169
129
135
139
151
137
159
165
171
167
125
123
127
69
165
163
161
107
57
63
133
131
121

FIG. 12
(A)
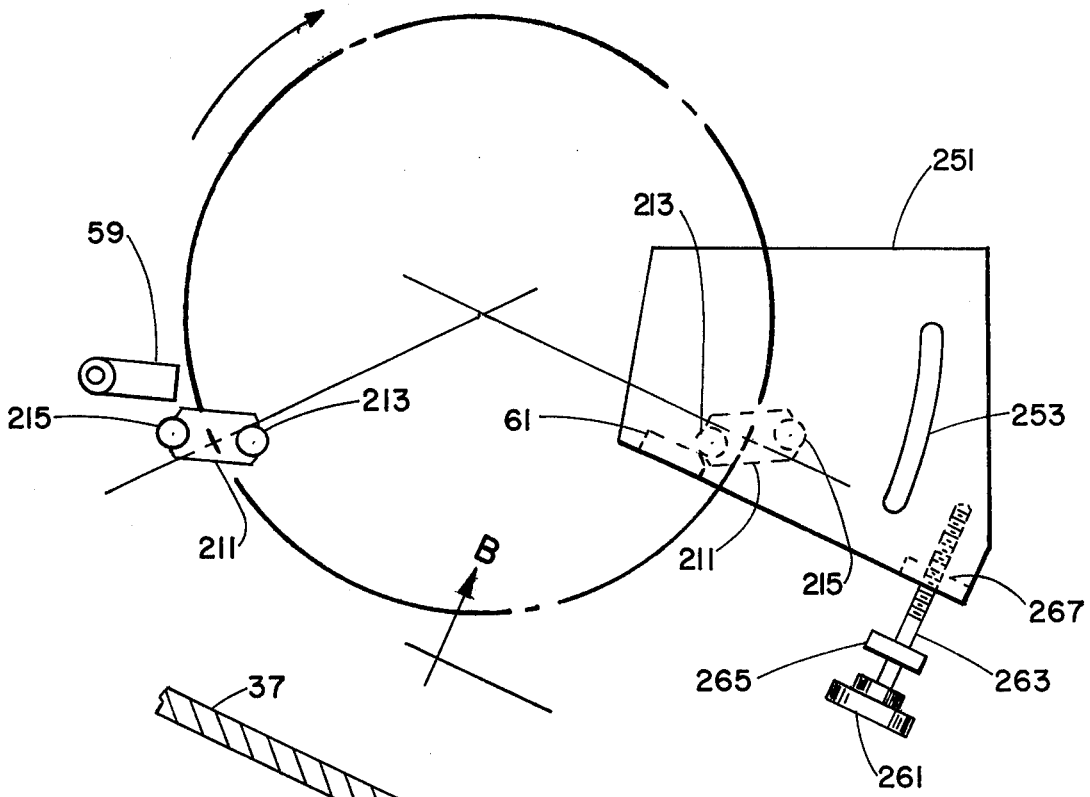
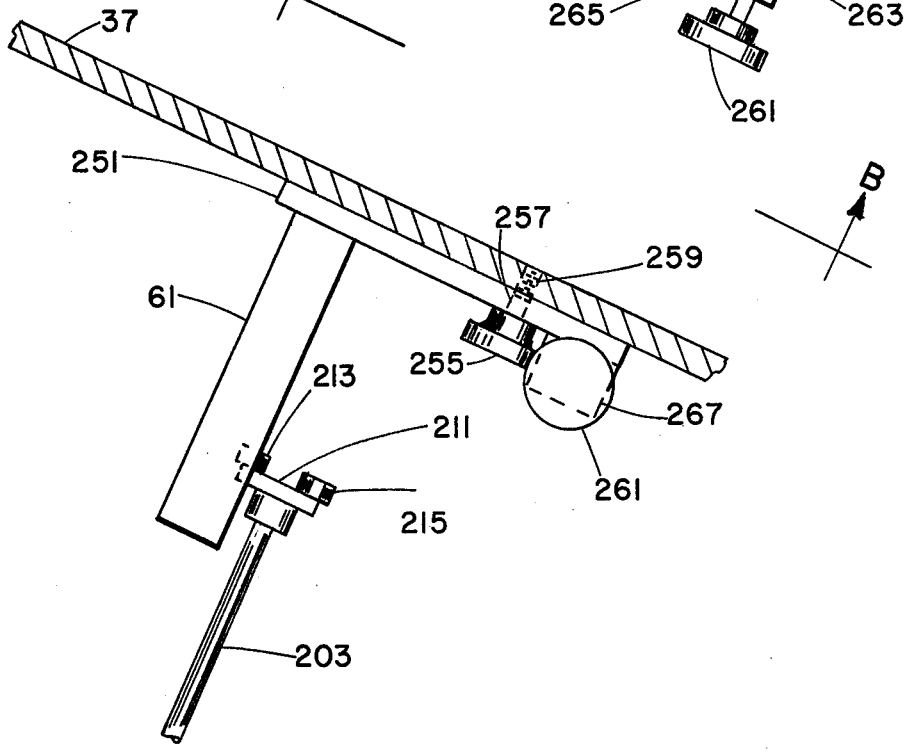
FIG. 12
(B)

CONTAINER FILLING MACHINE

This invention relates generally to filling machines, and more particularly to such mechines for automatically filling containers with a fluid-like material.

Modern filling machines for filling containers with a fluid must be capable of high-speed operation, while providing a multiplicity of other functions. For instance, in general the machines must discharge an accurate amount of fluid, repetitively into successive containers. It is desirable that provisions be made for providing adjustment of the amount of fluid to be so discharged into each container. Provision must be made to accommodate different sizes of containers; to prevent the discharge of fluid from a filling station in the absence of a container; to prevent dripping from the nozzles of each filling station when a container is not being or has been completely filled; to prevent the breakage of containers or machine mechanisms due to the jamming of a container at a filling station; and so forth.

To present inventive container filling machine provides all of and more than the above functions. This improved filling machine provides for individual or simultaneous adjustment of the volume of fluid discharged from each filling station into a container; for adjustment of the machine to accommodate different sizes of containers, even while the machine is running (if desired); for maintaining the nozzle of each filling station just above the rising level of fluid in an associated container being filled; for preventing the discharge of fluid when a container is not present; for inhibiting the further elevation of a container platform, when a container thereon becomes jammed; for greater than 180° of discharge cycle, over which time a substantially uniform velocity of fluid is discharged into a container; for programming the nozzle exit velocity to the fluid being discharged; for substantially eliminating drip from the nozzles when a container is not being filled; and so forth.

The foregoing and other features and advantages of the invention will be apparent from the following detailed description of the invention as illustrated in the accompanying drawings, wherein like items are designated by the same numeral, in which:

FIG. 4 is a cross-sectional plan view along 4—4 showing the sprockets on upper portions of jackscrews interconnected by a chain;

FIG. 5 shows a top view (A) and a contour view (B) of the master or pump actuating cam;

Figure 11A:
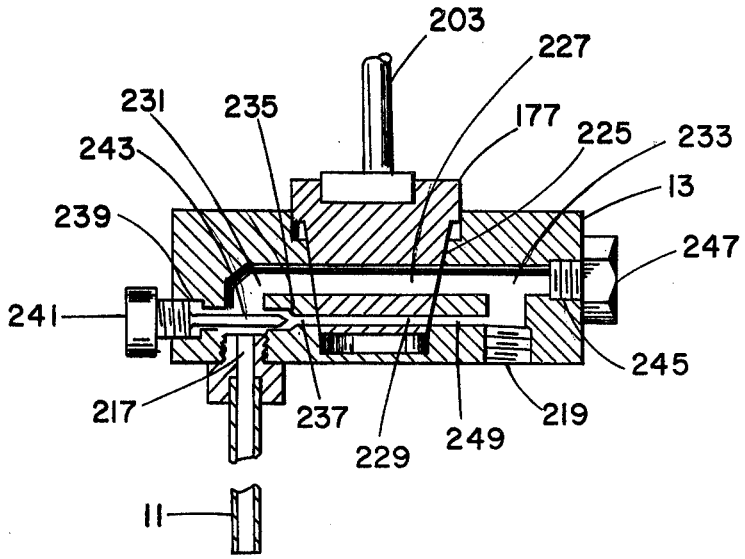
Figure 11B:
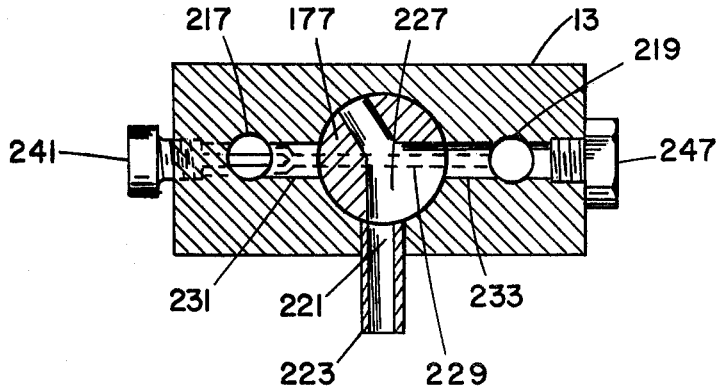
Figure 11C:
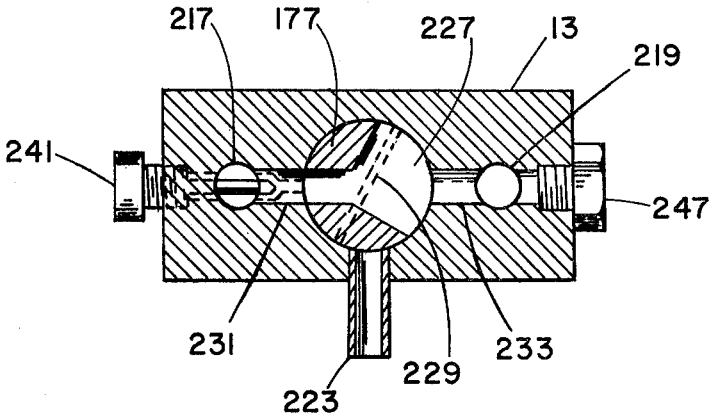
Figure 13:
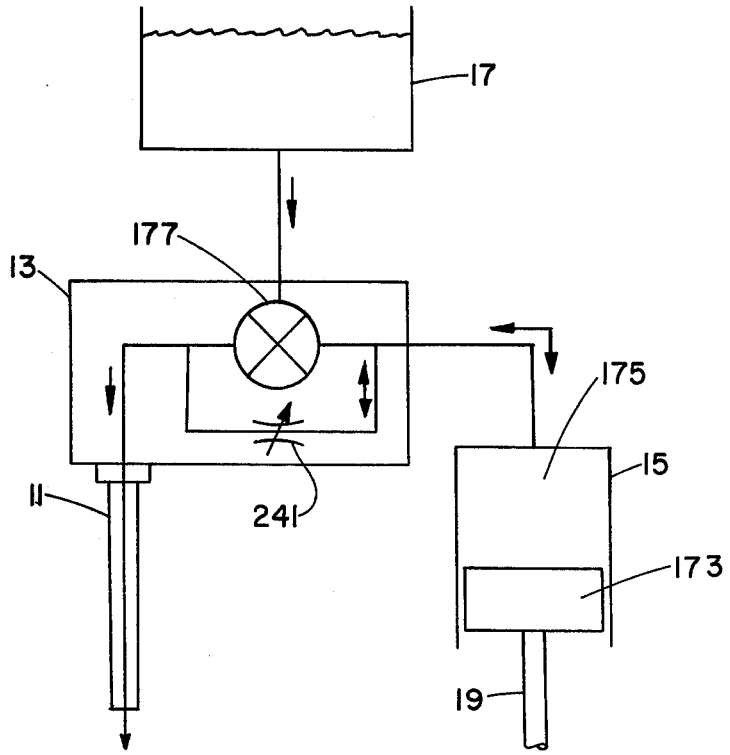
Figure 14:
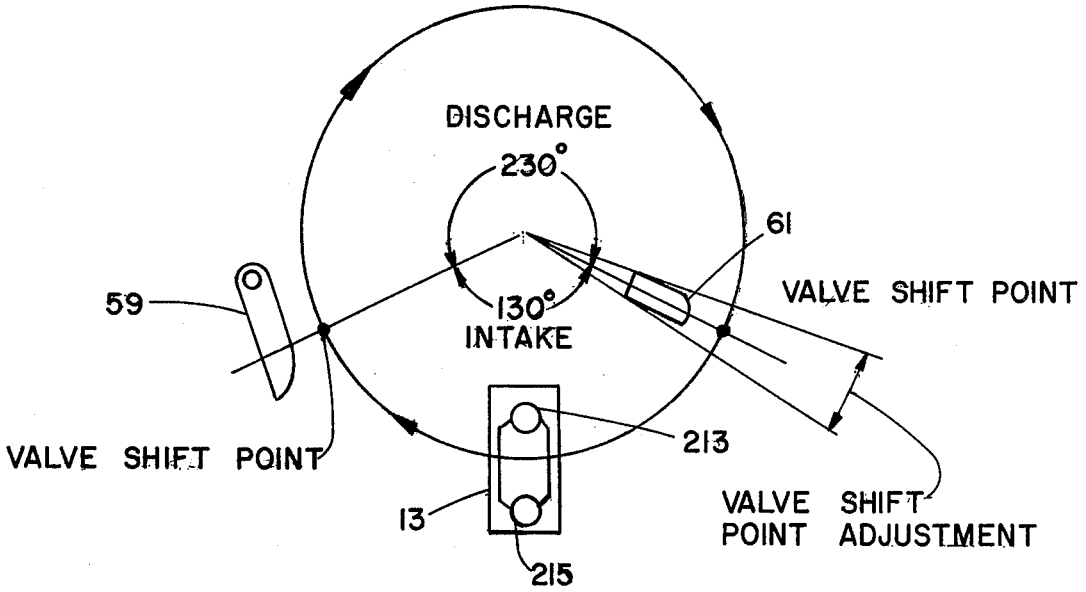
Figure 15:
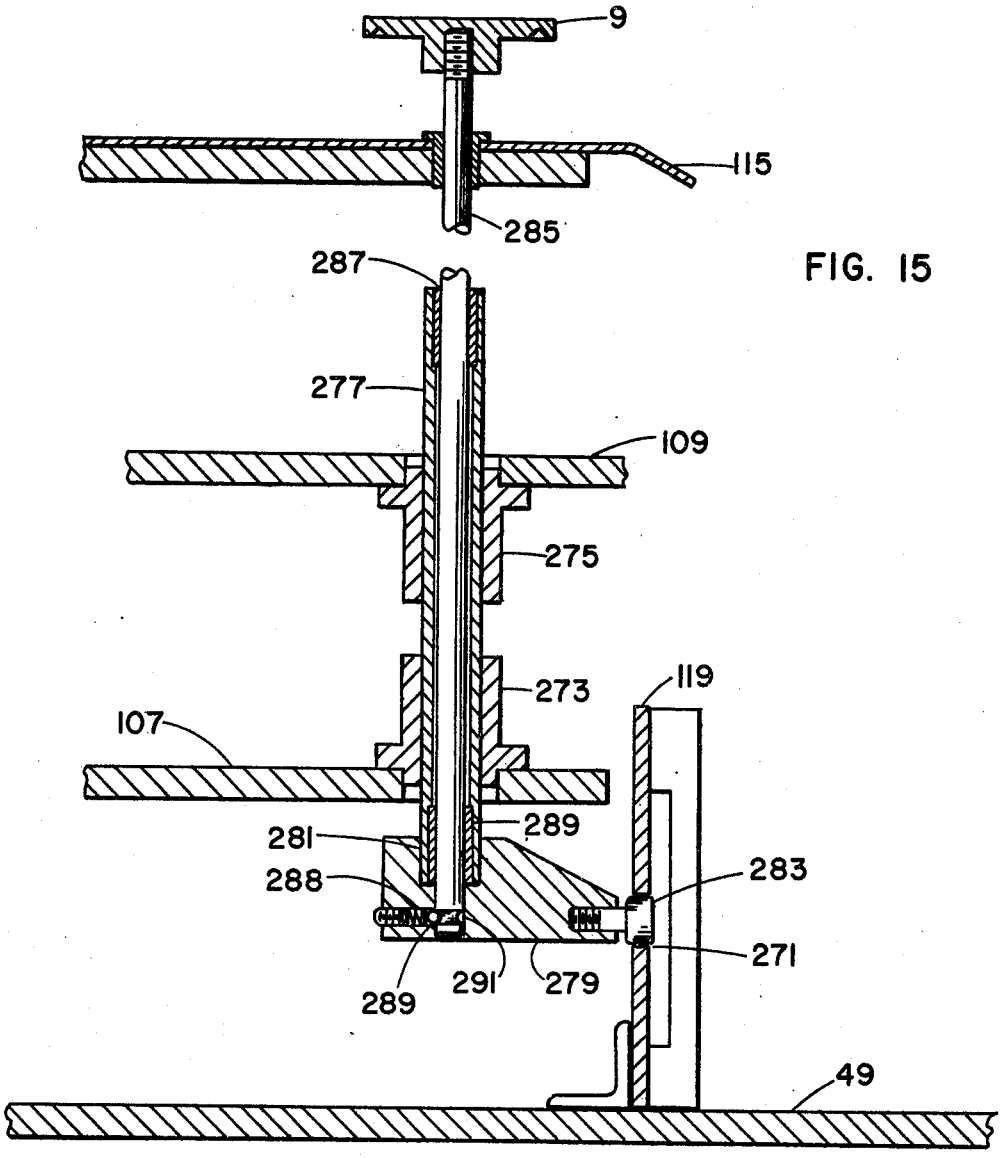
Figure 16:
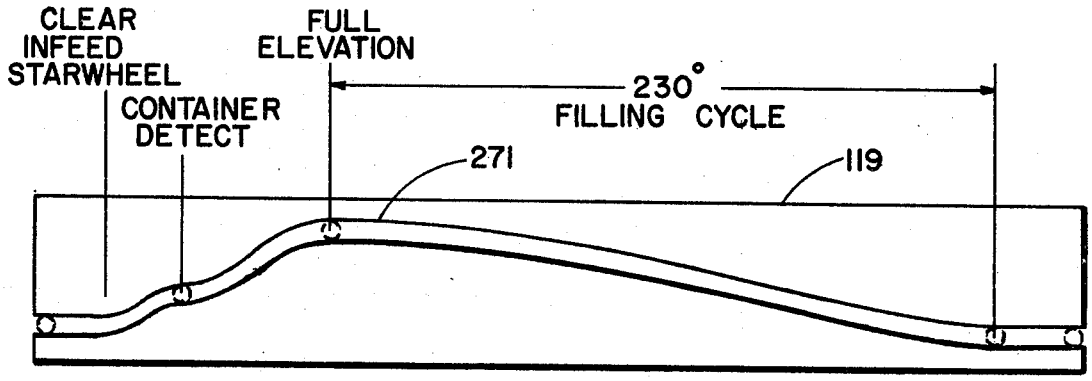

FIG. 11 view (A) is a cross-sectional elevation of an individual valve body showing individual drip control means, view (B) is a cross-sectional plan view of the valve body in intake position, view (C) is a cross-sectional plan view of the valve body in discharge position;

FIG. 12 (A) is a plan view of, and (B) a view taken at line B-B of, the gross drip control adjustment mechanism;

FIG. 13 is a diagrammatic view of the fluid flow path;

FIG. 14 is a diagrammatic view of the valve shift timing for the preferred embodiment;

FIG. 15 is a partial cross-sectional elevation view of an individual container elevating mechanism; and FIG. 16 is a diagrammatic view of the track of the container elevating cam.

Figure 1:
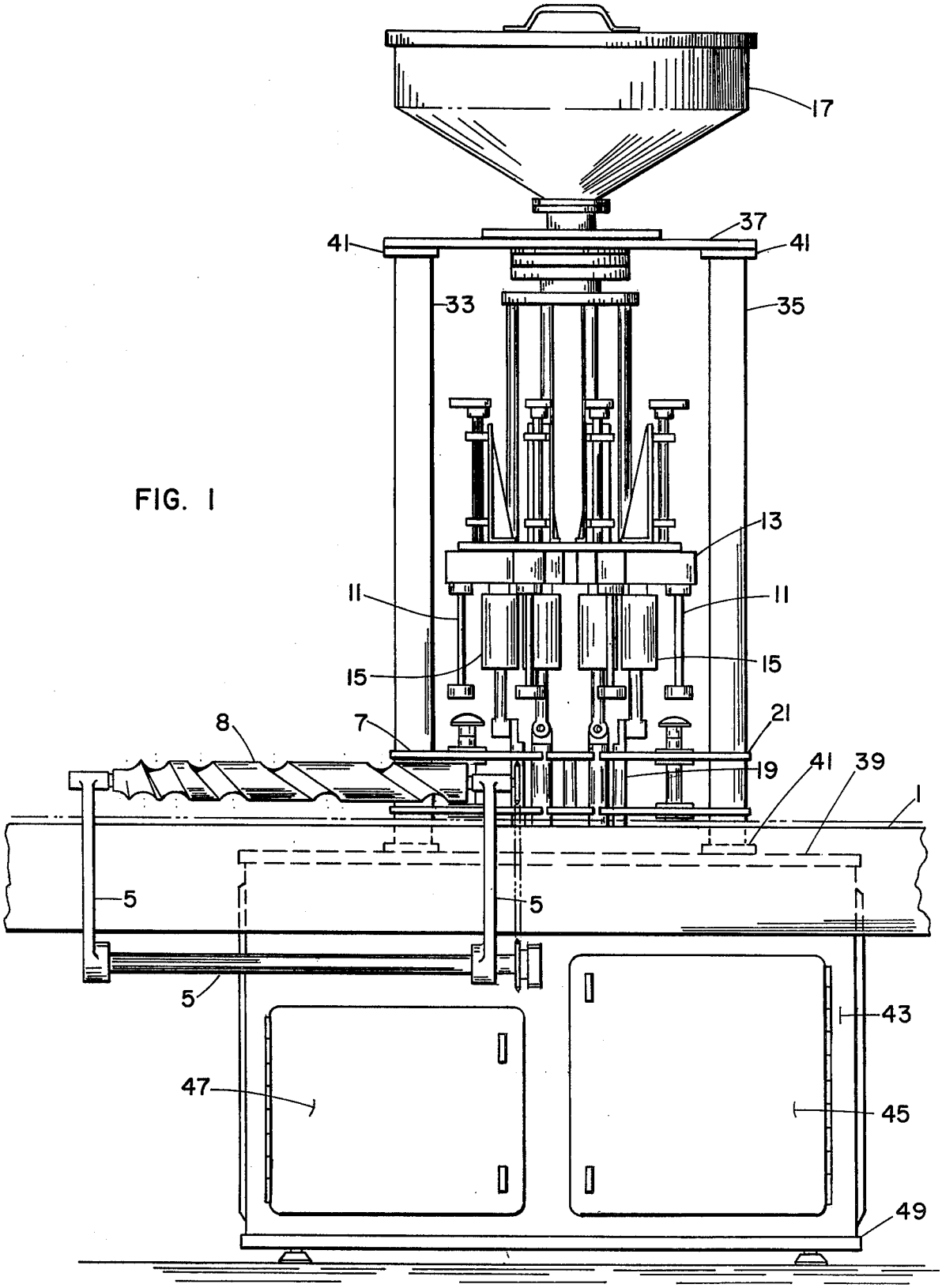
FIG. 1 is a front elevation view of the inventive container filling machine.
Figure 2:
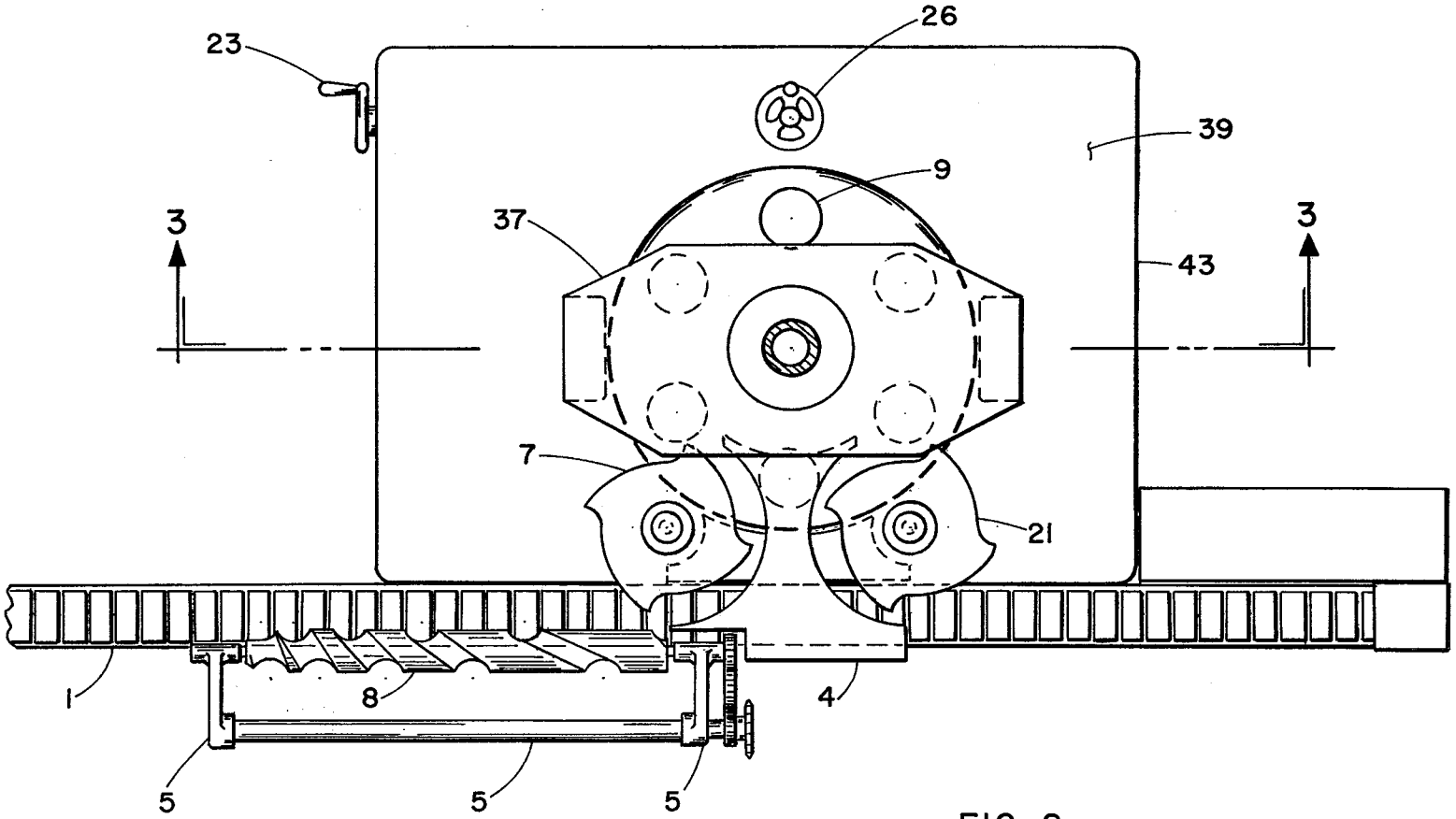
FIG. 2 is a plan view of the container filling machine.

The initial description is to present an over view of the basic inventive filling machine and its operation. A more detailed description of the machine mechanisms and their operation will follow. In FIGS. 1 and 2, the container filling machine of the present invention generally includes among other elements, a conveyor 1 driven in the direction of the arrows. Containers (not shown) to be filled with a fluid are placed on the conveyor 1 and moved toward the spacing screw 8 juxtapositioned to a portion of the length of the conveyor 1, as shown. Included with the spacing screw 8 is an assembly 5 providing for adjustment of, retention of, and quick removal of the spacing screw 8.

In normal operation, containers are moved into engagement with the revolving spacing screw 8, which separates and properly spaces the containers for properly timed entry into the filling portion of the machine. Once spaced, a container is engaged by the counterclockwise rotating infeed starwheel 7, appropriately positioned near the end of the spacing screw 8, and moved onto one of the container elevating platforms 9 (guiding is provided by centerguide 4). Six such platforms 9 are shown in this example, but a greater or lesser number can be provided. The platforms 9 are arranged in a circle and rotated in a clockwise direction. As the container is rotated away from the infeed starwheel 7, the associated platform 9 raises the container to a position where a filling nozzle 11 (there is one nozzle 11 located immediately above and rotating with each one of the platforms 9) is located within and proximate the inside surface of the bottom of the container. A mechanical sensing device, to be described in detail later, detects the presence of a container upon the platform 9, and enables a filling valve 13 to be shifted from a closed position to a discharge position. At this time and thereafter for up to approximately 230° of machine cycle, cam controlled pumping of a piston 15 (or syringe) is initiated to deliver product or fluid to nozzle 11 for discharge into the container. As the fluid level rises in the container, the container elevating platform 9 is lowered at the same rate as the level of the fluid rises, maintaining the nozzle just above the surface of the fluid, to avoid turbulence and other problems, such as foaming, for example.

When the container is filled, a valve shifting mechanism closes the valve 13, to prevent further discharge from the nozzle 11, and opens the valve 13 to an intake or charging position. With valve 13 so positioned, fluid from the bulk supply tank 17 will be drawn into the syringe 15 on the downstroke of the associated piston rod 19. Of course, the upstroke cycle of the piston rod 19 is used to force fluid from the piston 15 into the associated nozzle 11, for filling a container. The platform 9 is lowered to the level of the conveyor 1, and the filled container is swept or moved by the counterclockwise rotating delivery starwheel 21 onto the conveyor 1. As the platform 9 and associated nozzle rotate to receive the next container, the chamber of the piston 15 or piston filling pump 15 is refilled to a given volume of fluid.

The speed of the machine operation can be adjusted via a speed control handwheel 23. To accomodate different container heights, the assembly including the nozzles 11, valves or valve bodies 13, pistons 15, pump actuating or piston rods 19, and so forth, can be vertically raised or lowered with respect to the container platforms 9 (and other machine elements) via the container height adjustment handwheel 26. Similarly, the length of the stroke of the piston rod 19 is adjustable for changing the volume of fluid to be discharged into the containers. The container height adjustments can be made while the machine is running.

Figure 3:
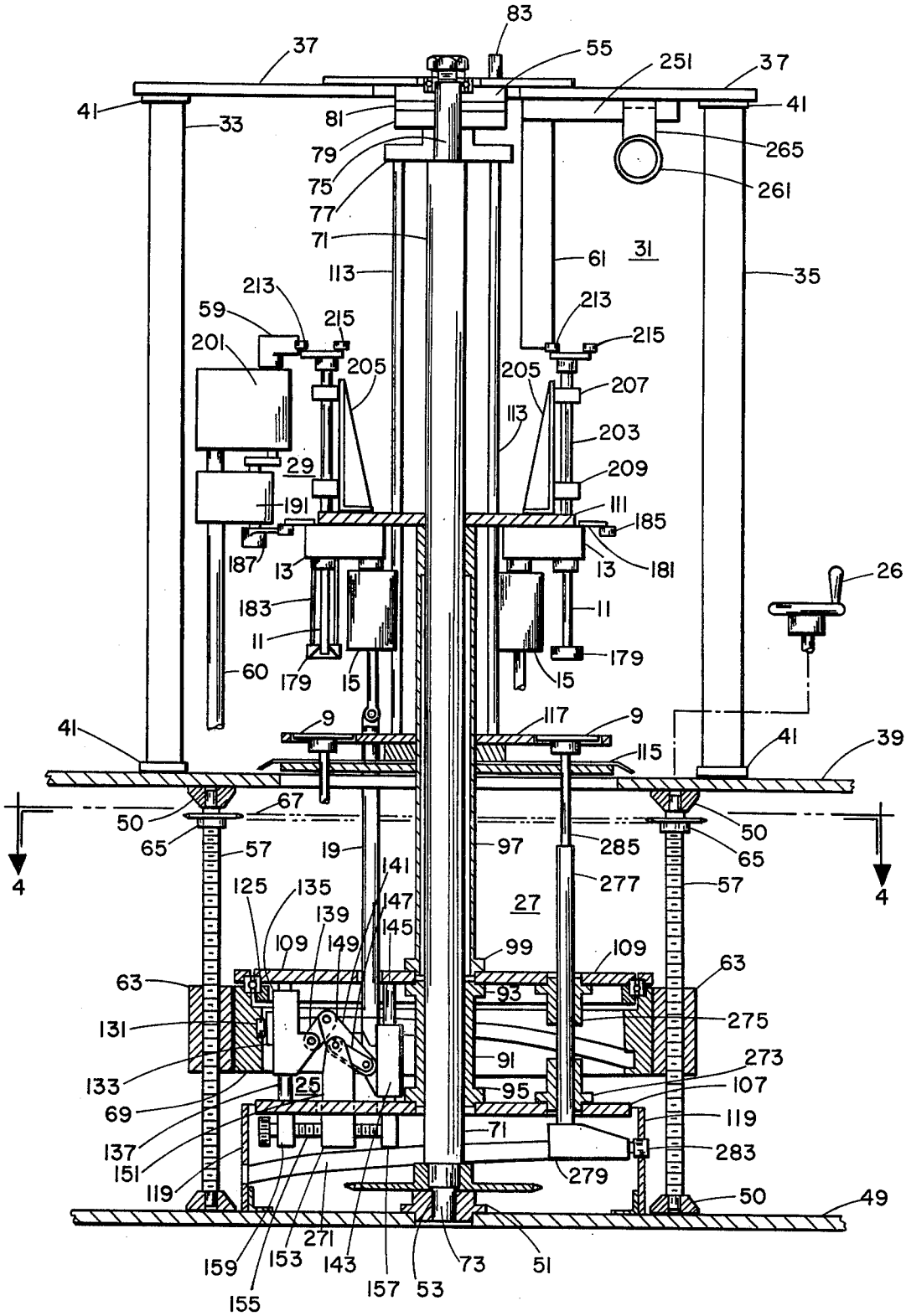
FIG. 3 is a cross-sectional elevation taken along 3—3.

In FIG. 3, a vertical sectional view of the filling machine shows partial detail views of a volume adjustment or stroke adjustment mechanism 25 for one piston pump 15, a container platform 9 elevating mechanism 27, and valve actuating mechanisms 29. Each one of the six filling stations, in this example, include such mechanisms. Also, with reference to FIGS. 1 and 2, the rigid and fixed frame-like members of this machine includes side or vertical columns 33 and 35, each rigidly connected at their uppermost ends to opposite ends of the bottom face of an upper horizontal support plate 37, and at their lowermost ends to opposite ends of the top face of a lower horizontal support plate 39. Anchor plates 41 are rigidly connected to the ends of the columns 33, 35 and bolted to the upper and lower horizontal support plates 37, 39. The lower horizontal support plate 39 forms the top of a cabinet 43 completely enclosing or serving as a housing for all mechanisms located below support plate 39. Access doors 45 and 47 are located on the front of the cabinet. The bottom of the cabinet is provided by a base plate 49. A lower seat and bearing 51 is rigidly attached to and located upon the top of the base plate 49. The top portion of the seat and bearing 51 is annular and has a centrally located circular recess 53. Also, a stationary plate 55 is centrally located upon the bottom of the upper support plate 37, and keyed to prevent rotation. Three individual jackscrews 57 are located vertically between the lower support and base plates 39 and 49, respectively, via bearings 50. The jackscrews 57 are evenly spaced along the circumference of a circle (every 120°), in this example. The ends of the jackscrews 57 are each seated within an individual one of the bearings 50, appropriately located and rigidly attached to the bottom and top faces of lower support and base plates 39, 49, respectively. A horizontally extending valve shift arm 59 is pivotally attached at one end to the upper end of a pair of vertical support rods 60. The lower ends of the vertical support rods 60 are rigidly attached to the nonrotating cam 69 (see FIG. 10). Another valve shift arm 61 is movably attached at one end to the bottom of upper support plate 37, and extends vertically downward therefrom. The valve shift arms 59 and 61 extend into the circular path of travel of the valve actuating mechanisms 29 (six in this example) at outer and inner radial points, respectively, of this circular path. The shift arms 59 and 61 are so located to open and close, respectively, the valves 13 as associated valve actuating mechanisms 29 pass by, as will be explained later.

A threaded bushing 63 is located on each one of the jackscrews 57 at a like distance from the base plate 49. A chain sprocket 65 is located on an uppermost portion of each one of the jackscrews 57 and rigidly attached thereto, a like distance from lower support plate 39. As shown in FIG. 4, a chain 67 interconnects the sprockets 65. With reference to FIGS. 3 and 5, a master barrel cam or pump actuating cam 69 is rigidly attached at points along its circumferential surface to the threaded bushings 63.

A rotatable center column 71 has a reduced lower end 73 seated in the circular recess 53 of the bearing 51. The lower drive sleeve 91, in conjunction with associated members 39, 49, 50, 57, 63, 69, 109, 125 provide the major support for center column 71. The drive sleeve 91 is slideably mounted upon the center column 71. A hanger plate 77, is rigidly mounted over the reduced uppermost portion 75 of the center column 71, as shown. Sandwiched between the top of the reduced end of the hanger plate 77 and the stationary plate 55, are a rotatable plate 79, and a tetrafluoroethylane seal 81 located between the top of the rotatable plate 79 and the bottom of the stationary plate 55. The seal 81, rotatable plate 79, and hanger plate 77 are rigidly connected together by suitable means, forming a portion of a rotary union.

Figure 6:
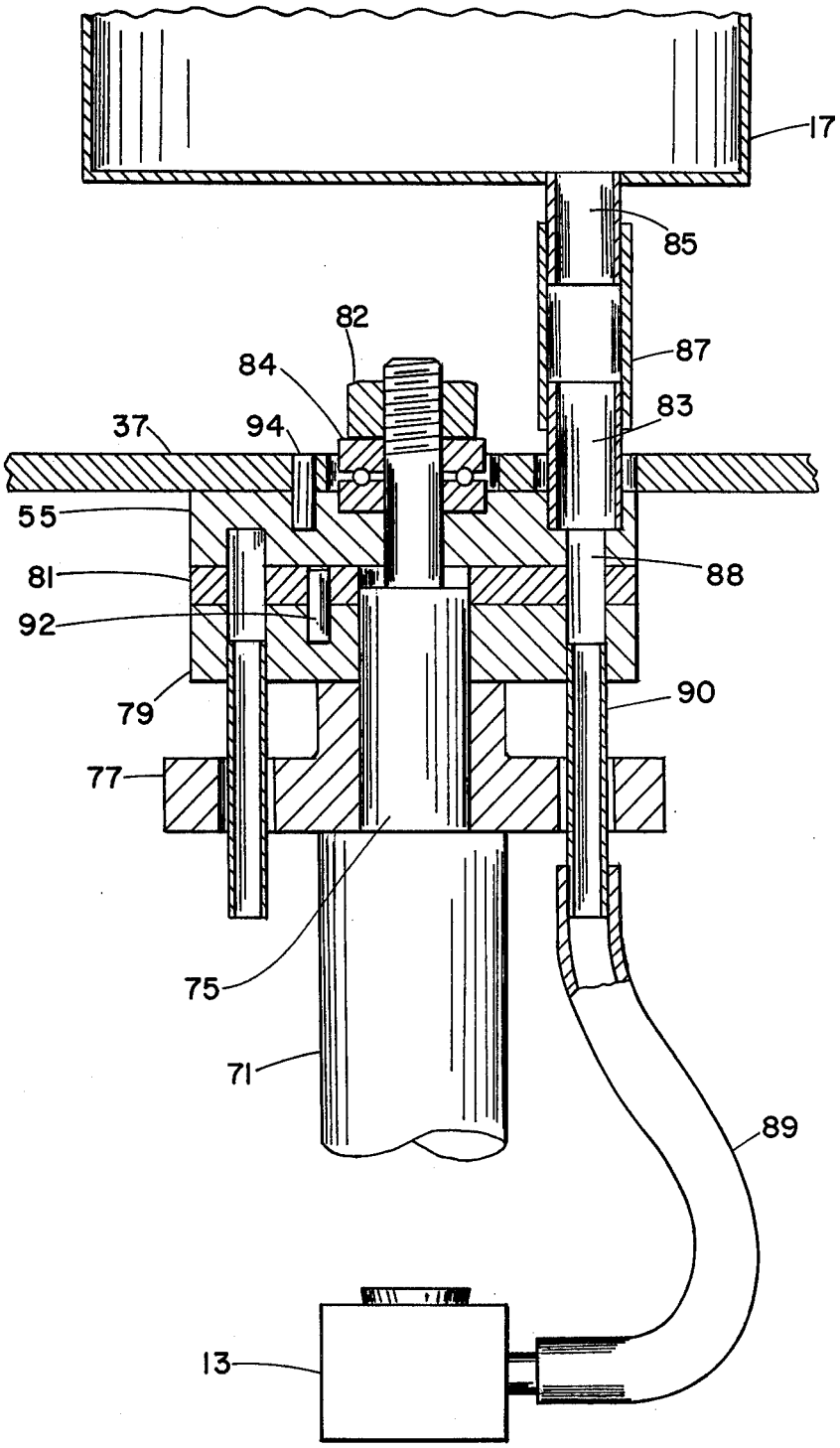
FIG. 6 is cross-sectional elevation view of the rotary union of the inventive machine.

With reference to FIG. 6, the rotary union provides a nipple 83 to which the outlet 85 of the bulk supply 17 is attached via a section of hose 87. Other sections of hose 89 lead from nipples 90 of the rotary union to each one of the valves 13, allowing fluid from the bulk supply 17 to be delivered (during a charge cycle) to the individual syringes or piston chambers 15, while rotating. The reduced upper end 75 of the center column 71 is partially threaded, as shown, and protrudes through the rotary union members 55, 79, and 81. A nut 82 is secured to the threaded and protruding portion of upper end 75 over a thrust bearing 84. Internal passageways, such as 88, interconnect intake 83 to the outlet nipples 90. A pin 92 keys rotatable plate 79 to the seal 81, to insure common rotation therebetween. Similarly, another pin 94 keys upper rotary union member 55 to plate 37.

Figures 7, 8:
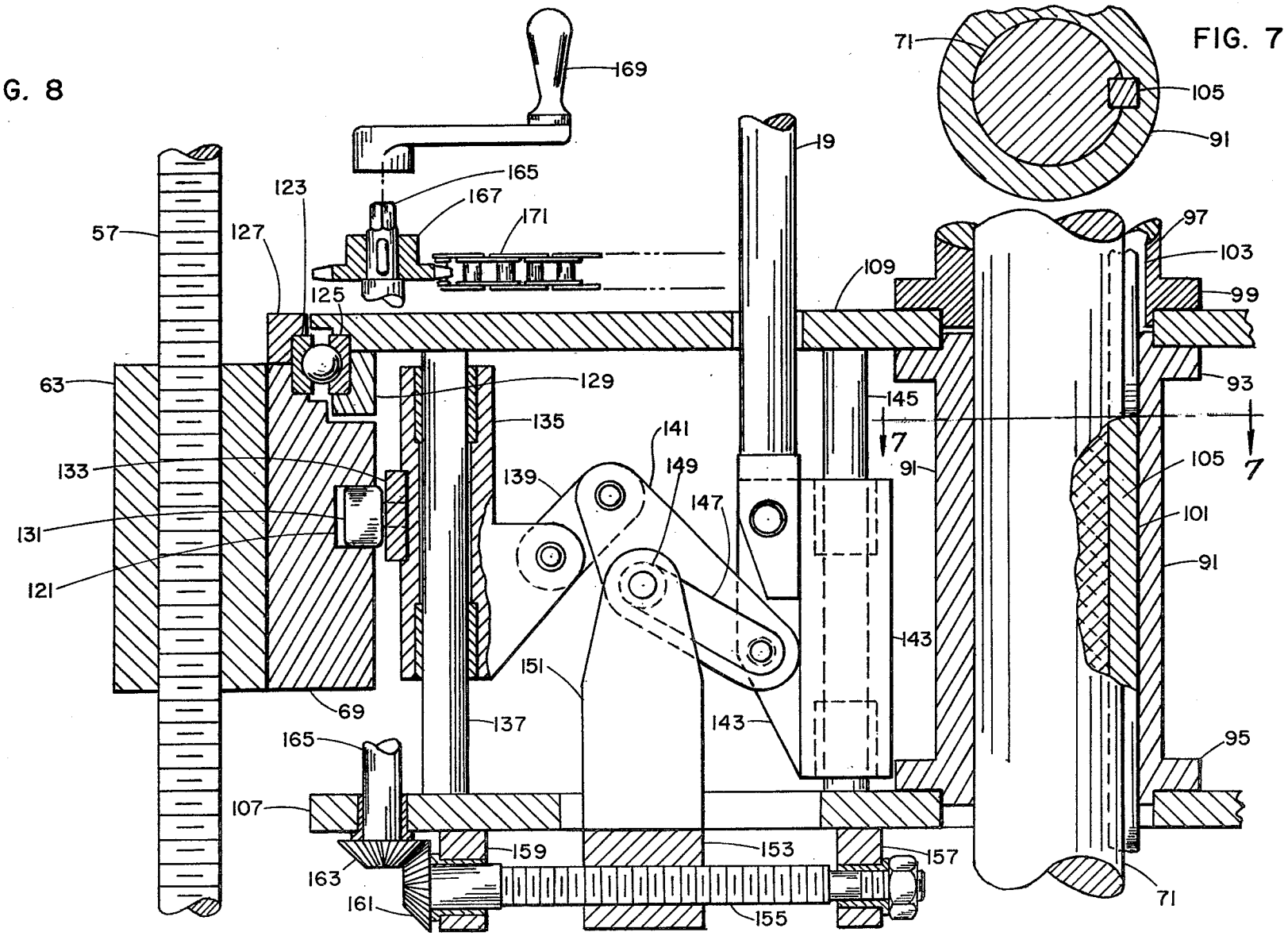
FIG. 7 is a top sectional view along line 7—7 of FIG. 8 showing location of drive key.
FIG. 8 is a partial cross-sectional elevation view of the volume adjustment mechanism.

A lower drive sleeve 91 is slideably mounted on the lower portion of the center column 71, and has upper and lower flanges 93, 95, respectively (see FIG. 8). An upper torque sleeve 97 having a lower flange 99 is slideably mounted upon the center column 71, directly above the lower drive sleeve 91. The lower drive sleeve 91 and upper torque sleeve 97 each have an axially running or longitudinal slot or keyway 101, 103, respectively, for engaging a key or spline 105 rigidly located upon the center column 71 (see FIGS. 3, 7, and 8). The keyways 101 and 103 engage the spline or key 105 in such manner, that the lower drive sleeve 91 and upper torque sleeve 97 are locked to the center column 71 for common rotation, but are each free to move vertically upon the center column 71. As will be described in detail subsequently, this vertical movement is required in adjusting the machine for filling containers of different heights, from one filling run to another.

A circular lower rotary plate 107 has a centrally located hole for mounting upon and is rigidly connected to lower circular flange 95 of drive sleeve 91. An upper circular rotary plate 109 has a centrally located hole for mounting upon the upper end of the lower drive sleeve 91. This upper rotary plate 109 is rigidly connected to and between the upper flange 93 of the drive sleeve 91, and the bottom flange 99 of the torque sleeve 97. A valve mounting plate 111 having a centrally located hole through which the center column 71 protrudes, is rigidly mounted (bolted for example) to the top of the torque sleeve 97.

Rotational drive power is applied to the lower drive sleeve 91 by motive means, which are not shown. Such means may include a variable speed motor or a motor driven gear box connected via gear, chain and sprocket, or belt and pulley mechanisms to rotate the lower drive sleeve 91 and interconnecting mechanisms at a desired angular speed.

Vertical support rods 113, six in this example, are evenly spaced from one another and the center column 71, and are rigidly attached at one end to the bottom of the hanger plate 77 (see FIGS. 1 and 3). The support rods 113 are run through holes in the valve mounting plate 111, and rigidly attached at their other ends to a horizontally oriented circular drip shield 115. Holes through this shield 115 are appropriately located to permit free movement of the container elevating platforms 9, the pump actuating rod 19, and the center column 71. The drip shield 115 is located at a level just below the container platforms 9, and is used to help prevent spilled product or fluid from dripping into the mechanisms underneath. A circular transfer plate 117 having holes similarly located as the drip shield 115, is located in the same horizontal plane as the container elevating platforms 9 at rest. The transfer plate 117 is rigidly attached to the vertical support rods 113, and provides a pathway or slideway between the container elevating platforms 9 and the conveyor 1, thereby permitting the infeed starwheel 7 to move or slide a container from the conveyor 1 onto a container elevating platform 9 for filling, and the delivery starwheel 21 to move a filled container from its platform 9 back onto the conveyor 1.

A container elevating barrel cam 119 is located as shown in FIG. 3. This cam 119 is rigidly attached along its bottom circumference to the top of the base plate 49. The cam 119 design and use will be described in detail below, along with the description of the container elevating mechanism.

The major framework, structural members, and certain portions of operating assemblies have now been described in greater or lesser detail. A detailed description of the assembly, operation, and design of the various operating assemblies will now be given.

Figure 9:
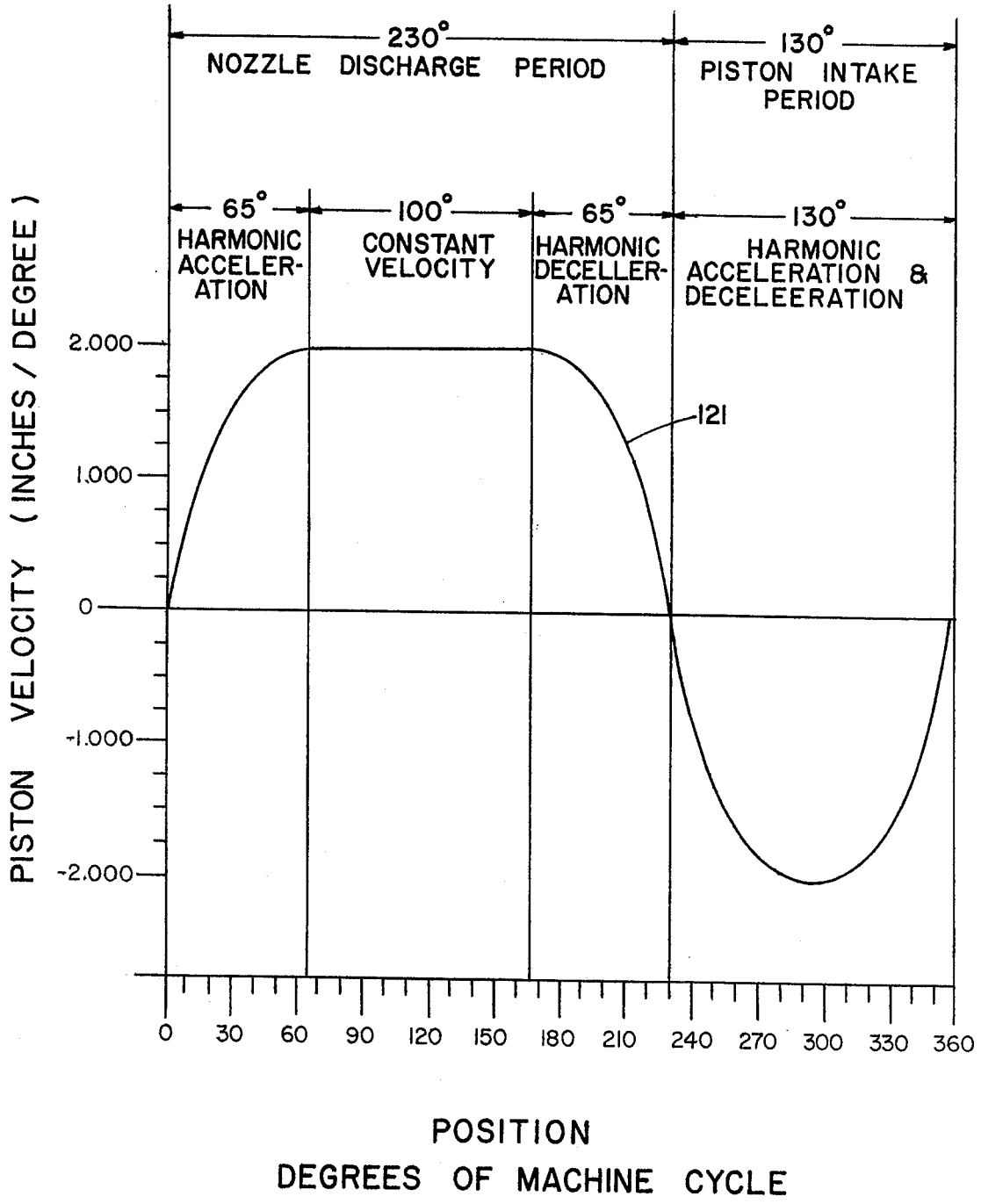
FIG. 9 is a diagram of the exit flow velocity curve for the velocity of fluid exiting from the nozzles, for a preferred embodiment.

The cam controlled pumping and volume (stroke) adjustment mechanisms 25, with reference to FIGS. 3 and 8, includes the master cam or pump actuating barrel cam 69 having an internally milled groove, track, or camway 121. This groove 121 is dynamically profiled, as shown in FIG. 9, the significance of which will be explained later. The pumping cam 69 is held in a fixed angular position by the bushings 63 mounted upon the jackscrews 57. The upper portion of the master cam 69 has a recess 123, for housing or retaining an angular contact rotary bearing 125. Upper and lower bearing retainers 127, 129 are located, as shown, for retaining the rotary bearing 125 in the recesses 123 of the cam 69. A cam follower 131 rides in the groove 121 of cam 69, and is rigidly attached to a cam follower bracket 133. The cam follower bracket 133 is in turn rigidly mounted upon a cam slide 135. The cam slide 135 is slideably mounted upon a vertical slide shaft 137 rigidly connected between the upper and lower rotary plates 109, 107. The cam follower bracket 133 is guided to prevent rotation around the slide shaft 137. A protruding arm of the cam slide 135 is connected by a movable link 139 to one upper corner of a substantially triangular crank lever 141. The opposing upper corner of the crank lever 141 is rotatabley mounted or pinned to a protruding arm of a pump slide 143. The pump slide 143 is slideably mounted upon a vertical slide shaft 145 rigidly connected between lower and upper rotary plates 107, 109 adjacent drive sleeve 91. The top of the protruding arm of the pump slide 143 is rigidly connected to the lower end of the pump actuating rod 19. A slot 147 of crank lever 141 is connected via a roller 149 to the upper end of a pivot bracket 151, extending upward through a hole in and from below the lower rotary plate 107. The lower end of the pivot bracket 151 is rigidly attached to the top of an adjuster block 153. The adjuster block 153 is internally threaded for mounting and movement upon a stroke adjusting lead screw 155.

One end of the stroke adjusting screw 155 is retained by a bearing 157 rigidly mounted to the bottom of the lower rotary plate 107 near the center column 71. The other end of the adjusting screw 155 protrudes through and is retained by another bearing 159 rigidly mounted to the bottom of the lower rotary plate 107. A bevel gear 161 is rigidly mounted upon the protruding end of the stroke adjusting screw 155. This bevel gear 161 is mated to or intermeshed with another bevel gear 163 rigidly mounted upon the end of a stroke adjusting drive shaft 165, protruding through a hole in the lower rotary plate 107 from above. The other end of the stroke adjusting drive shaft 165 protrudes through a hole in the upper rotary plate 109 from below, and has a sproket 167 rigidly mounted upon it. The top of the sprocket 167 is adapted for connection to a hand crank 169 or motor driven pulley (not shown). Each one of the six filling stations (more or less can be provided), include a cam controlled pumping and volume or stroke adjustment assembly 25, as described. A chain 171 is wrapped around all of the sprockets 167 of the mechanisms 25, thereby permitting simultaneous adjustment of the stroke length of the associated pump actuating rods 19, by turning a sprocket 167 of any one of the mechanisms 25. As shown, the upper end of the pump actuating rod 19 is connected to a piston head 173 of a piston pump 15. The longer the stroke, the greater the volume of fluid pumped. The valve 13 is connected to the upper portion of pump 15.

It should be noted that the rotary bearing 125, not only supports the upper rotary plate 109, but also supports all other of the rotating members or structure above and below the upper rotary plate 109. This bearing 125 encircles the bottom of the upper rotary plate 109. In other words, the rotary bearing 125 supports the lower drive sleeve 91, upper torque sleeve 97, and all rotating members directly or indirectly rigidly or captively connected to these sleeves 91 and 97.

In operation, the rotating center column 71 provides rotation of the cam controlled pumping and volume (stroke) adjustment assembly 25, causing the cam follower 131 to follow the groove or track 121 of the master barrel cam 69. In turn, the motion imparted to the cam follower 131 causes the cam slide 135 to move vertically up and down, in accordance with the dynamically profiled track 121 of cam 69 analogous to FIG. 9. Note that 0° represents the initiation of container filling, where fluid begins to enter a container. As cam slide 135 moves up and down, it causes (via link 139) crank lever 141 to pivot about roller 149 of the pivot bracket 151. As will be explained in detail later, the relative degree of pivoting of the crank lever 141, for a given vertical movement of cam slide 135, is controlled by the positioning of adjuster block 153. The relative pivotal movement of the crank lever causes the pump slide 143 to move up and down, in turn causing the pump actuating rod 19 to likewise move up and down. Upward movement is imparted to pump rod 19 during a discharge cycle, for forcing fluid from the piston chamber 175, through valve 13, and into a nozzle 11 for discharge into a container. Downward movement is imparted to pump rod 19 during a charge cycle, for drawing fluid into the piston chamber 175, from the valve 13. Fluid is delivered to the valves 13 from the bulk supply 17, via the rotary union assembly (see FIG. 6), as will be explained in greater detail below.

As previously mentioned, the cam 69 includes a dynamically profiled track 121. This track 121 is profiled for providing a relatively constant and controlled exit velocity of fluid from the nozzles 11, throughout a substantial portion of the 230° discharge cycle, as shown in FIG. 9. Similarly, such a profile can provide a relatively constant rate of charging of the pistons 15 throughout a substantial portion of the 130° of charge cycle. In comparison to some machines of the prior art employing a sinusoidal track, for providing simple harmonic motion to the pumps, a relatively higher maximum exit velocity can be attained by such machines. However, the dynamically profiled track 121 provides a lower overall or average velocity over the 180° discharge cycle of the prior art machine. The profile of the track 121 can be changed to program or tailor the exit velocity of fluid from a nozzle, to the viscosity of the fluid being discharged. Also, the present inventive machine extends the discharge cycle to about 230°. Since machine speed is dependent upon the exit velocity of fluid from a nozzle over a given period of time or machine cycle, the present machine is capable of running at higher speeds than such prior art machines.

The volume of fluid to be pumped from a particular pump 15 is adjustable by controlling the length of the stroke imparted to the pump actuating rod 19 by the pump slide 143. This is accomplished in one of two ways. The length of the stroke for the pump actuating rods 19 of each one of the pumping assemblies 25 (there are six in this example) can be adjusted or changed in unision by hand cranking or motor driving a sprocket 167 of any one of pumping assemblies 25. The chain 171 interconnecting the other sprockets 167 with the sprocket 167 being turned, will cause all of the sprockets to be turned a like amount. As a sprocket 167 is so turned, its associated stroke adjusting screw 155 will be rotated via the drive shaft 165 and bevel gears 163 and 161, in a direction to move the adjuster block 153 to a new position. For example, an adjuster block 153 is moved further away from center column 71, to lengthen the fulcrum point of crank lever 141, to increase the stroke length of pump rod 19 for a given vertical movement of cam slide 135. Contrarywise, the adjuster block 153 is moved toward the center column 71 to shorten the fulcrum point of crank lever 141, for decreasing the stroke length of pump rod 19. The fulcrum point is of course dependent upon the position of the roller 149 within the slot 147 of crank lever 141. Each one of the pumping assemblies 25 can be trimmed or adjusted individually by removing a cap screw (not shown) to free the associated sprocket 167 from its drive shaft 165. The drive shaft 165 can now be turned to move the adjuster block 153 to a position for obtaining a desired stroke length for the associated pump rod 19, without affecting the other pump assemblies 25. Also, in this manner, the pump assemblies 25 may be adjusted for different volumes, for the same height containers, where each pumping assembly 25 is associated with nozzles 11 of equal length; or if different lengths of nozzles 11 are used between pumping assemblies 25, a mix of containers having different volumes and heights can be filled.

It should be noted that the piston pump 15 can be any one of a number of known designs. A piston pump that is ideally suited for use in this inventive filling machine, is as described and claimed in our patent, PISTON PUMP MECHANISM, U.S. Pat. No. 4,020,750, issued on May 3, 1977.

Figure 10:
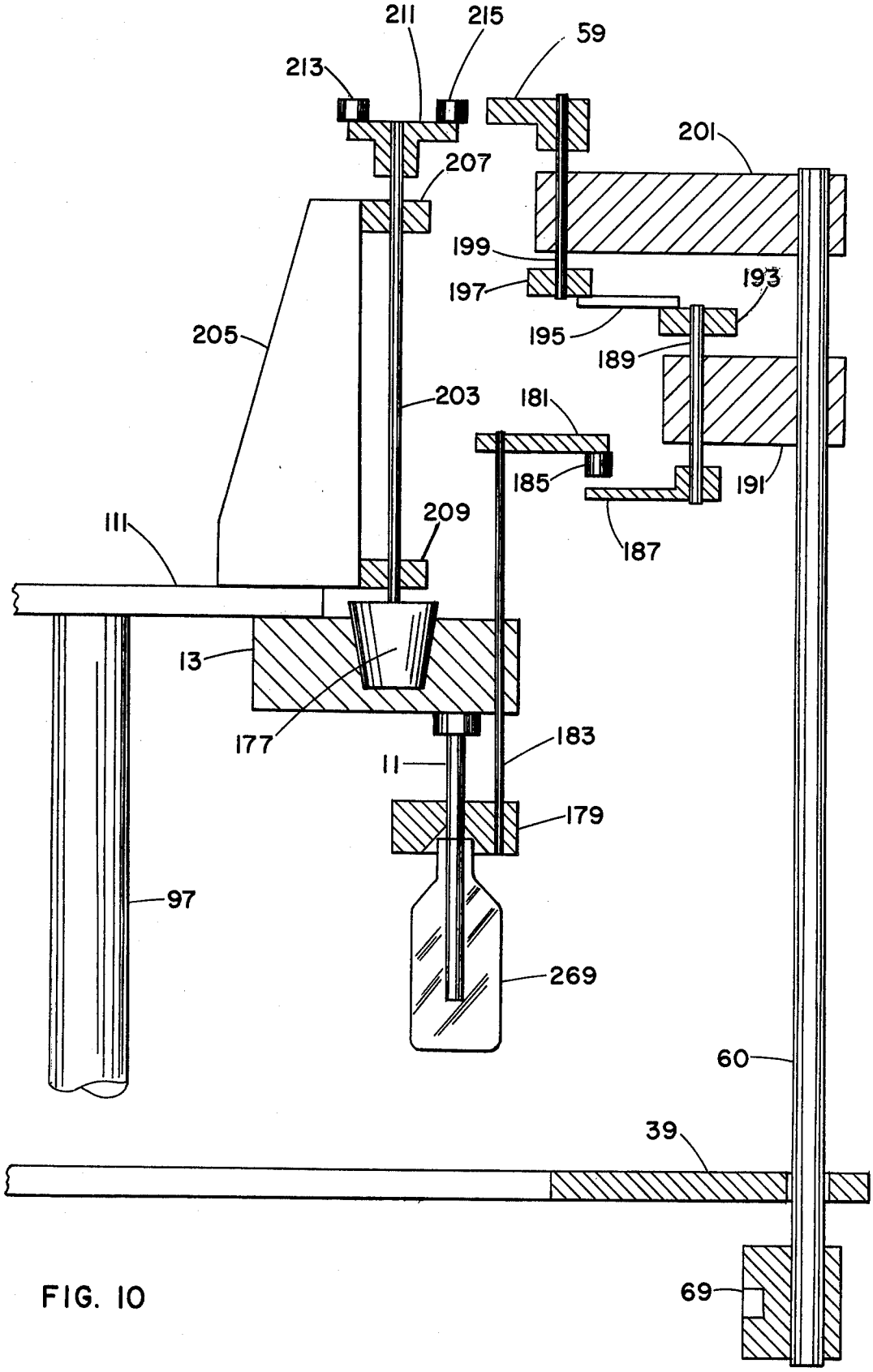
FIG. 10 is a partial cros-sectional elevation view showing the container detect mechanism.

With reference to FIGS. 3, 10 and 11, each valve actuating mechanisms 29 includes container detect and drip control mechanisms, the operation of which will be described later. The valve body 13 includes a plug 177. The nozzle 11, extending downward from the valve 13, is run through a centering core 179, rigidly connected to a detector plate 181 by two juxtaposed tie rods 183. A cam follower 185 is rigidly attached to the bottom of the detector plate 181, as shown. A cam 187 has one end located in the same plane as cam follower 185, when no container is present, and the top of an opposite end rigidly connected to one end of a rod 189. The rod 189 is run through and rotatably mounted within a support arm 191, rigidly attached to and extending from vertical support rods 60. The top of the rod 189 is retained and secured by a linkage arm 193. A linkage 195 is used to contact linkage arm 193 to another linkage arm 197. Another rod 199 is rigidly attached at its lower end to the top of linkage arm 197, and run through and rotatably mounted within another support arm 201, extending from and rigidly attached to vertical support rods 60. The upper end of rod 199 is rigidly connected to one end of a shift arm 59.

The housing of the valve 13 is mounted at one end to the bottom of the outer portion of the valve mounting plate 111. The lower end of a rod like valve crankshaft 203 is rigidly attached to the top of the valve plug 177. A triangular like bracket 205 is rigidly attached at its base to the top of the valve mounting plate 111 (see FIG. 3). The crankshaft 203 is run through and retained by upper and lower support arms 207, 209, each rigidly attached at one end to the outer vertical edge of bracket 205. The crankshaft 203 is free to rotate. A valve crank 211 is rigidly mounted upon the upper end of the crankshaft 203. First and second rollers 213, 215, are mounted on the top of and at opposite ends of the valve crank 211. The rollers 213 and 215 each serve as cam followers.

In FIG. 11, the valve body 13 includes a nozzle port 217 for connection to a nozzle 11, a pump port 219 for connection to pump 15, and an intake port 221 for receiving fluid through an intake nipple 223 from the bulk supply 17, all located as shown. A tapered and truncated hole 225 is located within the top of the valve body 13. The truncated portion and small diameter of the hole 225 is located near, but not through, the bottom of the valve body 13. A tapered valve plug 177, cut out as shown, includes a major chamber 227, and a by-pass passageway 229. The valve body 13 also includes a nozzle port passageway 231 run from the nozzle port 217 to the hole 225, as shown. A pump port passageway 233 is run from the pump port 219 to hole 225, as shown. The vertical portion of the nozzle port passageway 231 includes in an inner wall, an orifice 235 connecting to a by-pass passageway 237 exiting into hole 225; and in an outer wall the reduced end of a hole 239, having a threaded unreduced end cut through the side of the valve body 13, for retaining and permitting adjustment of a needle valve 241. The needle 243 of needle valve 241 protrudes across the nozzle port passageway 231 into the orifice 235. The exit point locations of nozzle and pump passageways 231 and 233, into hole 225, are directly opposite one another. The outer wall of the pump port passageway 233 has a threaded hole 245 through the side of valve body 13, for retaining a plug 247. A by-pass passageway 249 is run from the vertical portion of pump passageway 233 into hole 225, opposite the entry point of the nozzle by-pass passageway 237 into hole 225.

In FIG. 12, the upper end of valve shift "closing" cam or arm 61 is rigidly attached to the bottom of a slide plate 251. A slot 253 is located in the slide plate 251, as shown. A clamp knob 255 has a stem 257 threadably mated through slot 253 to a hole 259 in the upper support plate 37, for clamping the slide plate 251 in a particular position. An adjusting knob 261 has a stem 263 supported at one end by a bracket 265 rigidly mounted to the upper support plate 37. The other end of the stem 263 is threaded and mated within a threaded hole of a bushing 267 rigidly mounted to the bottom of plate 251. The adjusting knob 261 is turned to move the slide plate 251, for adjusting the position of the valve shift cam 61 with respect to the path of travel of the valve cranks 211 of the container filling stations.

Operation of the valve actuating mechanism 29, and container detect mechanism will now be described. As previously explained, a pump 15 is charged (filled with fluid) during the downstroke of its piston 173. During charging, the valve plug 177 is positioned as shown in FIG. 11 (B), whereby intake passageway 221 is open to pump port passageway 233, via chamber 227 of valve plug 177. Fluid is drawn into piston chamber 175 of pump 15, during this charging time (see FIG. 13), from the bulk supply 17. After charging of pump 15 is accomplished, valve plug 177 is rotated through 90° to the discharge position (see FIG. 11 (C)), whereby the nozzle port passageway 231 is coupled to, or has open passage to, the pump port passageway 233, via chamber 227 of valve plug 177. Discharge is now accomplished in this valve 13 position by the up stroke of piston head 173, forcing fluid from the pump chamber 175, through pump port 219 to nozzle port 217, and into the delivery nozzle 11.

The valve plug 177 is moved to the discharge position by means of the shift arm 59 engaging roller 215 of valve crank 211, as the rotating filling assembly passes the location of shift arm 59 (see FIGS. 3, 10, 11, 12, 13 and 14). The filling assembly rotates 230° during the discharge or filling cycle. After 230° of filling time, the valve crank 211 is returned (rotated) to the charging or intake position, as roller 213 passes and engages the valve shift closing cam 61. Obviously, the charge cycle or time is 130° of filling assembly rotation and machine cycle time, in this example. Clearly, the discharge cycle can be made greater or less than 230°, if desired.

It is desirable to include a container detection device or mechanism, to prevent fluid discharge in the event that no container 269 is present, during a filling cycle for a filling station. In FIG. 10, a container 269 is sensed by the vertical movement of the centering cone 179, which engages the rim of the top of the container 269, while it is being elevated for filling by the container elevating mechanism 27. If a container 269 is in proper position, the detector plate 181 is lifted, so that cam follower 185 does not engage cam 187, allowing the cam follower shifting arm 59 to remain in position for engagement with roller 215. In the absence of a container 269, the centering cone 179 and associated detector plate 181, both remain in a downwardmost position, so that cam follower 185 is allowed, as it rotates by, to engage and rotate cam 187. In turn, the rotation of cam 187 is such that the cam shift arm 59 is rotated via linkage 195 to a position preventing roller 215 from engaging this cam shift arm 59. In this manner, the associated valve plug 177 is prevented from being rotated in the valve body 13 to the discharge position, as previously described. In this case, upward movement of the associated piston head 173 of a pump 15, pumps fluid back into the bulk supply 17, as opposed to the filling nozzle 11. The reason, of course, is that the valve plug 177 has been left in the charge position.

Operation of the drip control mechanism for this inventive container filling machine will now be described. This mechanism substantially eliminates nozzle drip during the period of time between discharging and charging a pump 15. With particular reference to FIGS. 12 and 14, this is accomplished by delaying the shifting of a valve plug 177 to the charge position, after approximately 230° of discharge cycle time. In this manner, fluid is drawn back into the associated nozzle 11, by the beginning of the downstroke of the associated piston head 173, causing fluid to be sucked back into the pump chamber 173 from the nozzle 11, just prior to initiating the charge cycle. The delay time period is controllable, for adjusting to fluids of different surface tension, via adjustment of slide plate 251, as previously described. Movement of the slide plate 251 adjusts the angular position of the valve shift closing cam 61, for obtaining the desired delay time. Adjustment of the angular position of the valve shift closing cam 61 in the path of travel of the valve cranks 211 of the various filling stations, is for all valve actuating assemblies 29 (see FIG. 14).

Due to variations in manufacturing tolerances, it is desirable to also provide an individual drip control for each filling assembly or station. With reference to FIG. 11, this is provided by means of the needle valve 241 and by-pass passageways 237 and 249 of a valve body 13, and by-pass passageway 229 of the associated valve plug 177. When a valve plug 177 is in the charge or intake position (see FIG. 11(A,B)), the by-pass passageways 237, 229, and 249 are aligned or open to one another, permitting fluid to be drawn back from an associated nozzle 11 into the chamber or cylinder 175 of the associated pump 15. Such drawback is continuously provided during the charge cycle. The amount of fluid drawn back during a pump 15 charging cycle is controlled by adjusting the position of the needle 237 of the associated needle valve 241 in the orifice 235 of the by-pass passageway 237.

In operating high-speed filling machines, such as this inventive machine, bottom up filling of containers 269 is a desirable feature (distance between rising surface of fluid and discharge end of filling nozzle 11 remains constant). Ideally, the end of the nozzle 11 is held just above the surface of the rising fluid, thereby substantially reducing foaming, splashing, and so forth. In FIGS. 3, 15, and 16, a container elevating mechanism includes a container elevating barrel cam 119, rigidly mounted to the base plate 49. This barrel cam 119 has a cam track 271, designed as shown in FIG. 16. The barrel cam 119 is shared by all of the container elevating mechanisms 27 of this filling machine. Linear bearings 273, 275 are mounted in holes in the lower and upper rotary plates 107, 109, respectively. An outer sleeve 277 is slideably mounted within the linear bearings 273, 275. A follower arm 279 has a hole 281 into which the lower end of the outer sleeve 277 is rigidly mounted. A cam follower 283 is rigidly attached to and projecting from the end of a tapered projection of follower arm 279. The cam followers 283, for each container elevating mechanism 27 (six in this example) ride within and follow the track 271 of the container elevating cam 119, as the cam followers 283 are rotated via rotation of the rotary plates 107, 109. Mounted within the outer sleeve 277 is a portion of an inner rod 285 held in position by upper and lower bearings 287, 289, and a ball detent assembly to be described. The container platform 9 is rigidly mounted to the top of the inner rod 285 projecting through a hole in the rotary splash or drip guard 115 (see FIG. 2). In normal operation, the combined action of the rotating upper and lower rotary plates 109, 107 and the cam follower 283 following cam track 271, causes the container elevating platform 9 to be moved vertically up and down, in the proper timed relationship with the operation of its associated cam controlled pumping assembly 25. The cam track 271 is designed to control the vertical position of the container elevating platforms 9, for maintaining the nozzles 11 just above the rising surface of the fluid being discharged into their associated container 269, during a discharge cycle. Of course, cam track 271 could be otherwise designed, for example, for maintaining the nozzle just below the rising surface of fluid, and so forth.

It is desirable to provide a safety mechanism, for preventing containers 269 from being crushed or broken, whenever an associated nozzle 11 fails to properly enter the neck of a container 269. In FIG. 15, such a jam prevention mechanism is provided by means of a spring 288, located in one end of follower arm 279 and protruding into the outer sleeve 277, as shown. A ball 289, located as shown, is biased and forced by the spring to engage a groove 291 just above the lower end of and around the inner rod 285. As shown, the combination of the spring 288 biasing ball 289 into the groove 291 of inner rod 285, forms a spring biased ball detent assembly, for retaining the rod 285 in the position shown, during normal operation. If for any reason, a container platform 9 is restricted or prevented from completing its upward motion or movement, the downward force imparted to the container platform 9 by the restriction, and upward force from the rising cam follower 283 upon the outer sleeve 277, will combine to cause the ball detent 289 to release. Such release of the ball detent 289 will allow relative movement between the inner rod 285 and outer sleeve 277. As a result, the platform 9 will be retained at or drop below its last vertical position, prior to being restricted from further upward movement. The inner rod 285 is returned to its normal position as its associated cam follower 283 approaches the lowest point in the cam track 271. At this time, the container platform 9 is restrained from further downward movement by the rotary splash guard 115, permitting the ball detent 289 to re-enter the groove 291 in the inner rod 285. A key 278 is rigidly connected along a longitudinal portion of the outer sleeve 277, and cooperates with keyways 280 and 282 of linear bearings 273, 275, respectively, to prevent rotation of the sleeve 277 within the bearings 273, 275.

An important mechanism of this inventive container filling machine is the container height adjusting mechanism. The major portions of this mechanism have already been described, as has a brief description of the operation of this mechanism. With reference to FIGS. 3 and 4, the handle or handwheel 26 (could be replaced by a motor drive) can be connected to the top end of any one of the three jackscrews 57. When one such jackscrew 57 is turned via handwheel 26, the chain 67 interconnecting or wrapped around a portion of each of the sprockets 65, is driven to turn all of the jackscrews 57 a like amount. The resultant clockwise or counterclockwise turning of the jackscrews 57, will cause the threaded bushings 63 to move up or down upon their associated jackscrews 57. Such vertical movement of the bushings 63 causes corresponding vertical movement of the machine elements directly or indirectly interconnected thereto. Such elements obviously include the pump actuating cams 69, the stroke adjusting mechanisms 25, valve actuating mechanisms 29, upper and lower rotary plates 109, 107, valve mounting plate 111, lower drive sleeve 91, upper torque sleeve 97, and such other machine parts or elements integral with or rigidly attached to the former. The container height adjustment can be made while the machine is running. The fixed datum plane to which such vertical movement can be referenced, can, for example, be the horizontal plane of the rest or downwardmost position of the container elevating platforms 9.

What we claim is:

1. In a container filling machine, the combination comprising:

a plurality of container platforms;

a bulk supply tank for storing fluid;

a plurality of piston pumps each including a piston rod;

a plurality of nozzles;

a plurality of valves, each one of said valves being associated with and having an individual piston pump and individual nozzle connected thereto, said nozzle projecting downward from said valve above a particular one of said container platforms;

means for delivering fluid from said bulk supply to said valves;

means for operating said valves to deliver fluid from said bulk supply tank into said piston pumps during a charging cycle, and from said piston pumps into said nozzles during a discharge cycle;

cam controlled pumping means including: a barrel-like pump actuating cam having a track; and cam follower means resting partially within and guided by said track, for providing pumping movement correspondence with the profile of said track; said cam controlled pumping means providing in combination with said valve operating means, greater than 180° of machine time for continuously discharging fluid from said nozzles during the discharge cycle; and stroke adjusting means including: a plurality of crank levers pivotally connected between said cam follower means and individual ones of said piston rods of said piston pumps, respectively; and means for controlling the pivoting of said plurality of crank levers for providing infinite adjustability in a range between zero and maximum stroke of the stroke of said piston pumps without necessitating changing of the profile of said pump actuating cam.

2. The container filling machine of claim 1, wherein the combination of said cam controlled pumping means and said stroke adjusting means further includes:

a rotatable center column;

an upper rotary plate mounted between said center column and an uppermost portion of said cam;

a lower rotary plate mounted upon said center column below said upper rotary plate;

a plurality of first and second slide shafts mounted between said upper and lower rotary plates, and juxtaposed to said cam and column, respectively, each one of said first and second slide shafts being associated with a particular one of said piston pumps;

a plurality of cam slides, each one of which is mounted upon an individual one of said first slide shafts, for vertical movement thereupon;

a plurality of cam followers rigidly mounted one upon each cam slide, each cam follower having a free end protruding into and guided by said track of said cam;

a plurality of pump slides, each one of which is mounted for vertical movement upon an individual one of said second slide shafts, and rigidly connected to a lower end of an individual one of said piston rods; and said means for controlling the pivoting of said plurality of crank levers includes: a plurality of pivotal connection means; said plurality of crank levers each being pivotally connected via an individual one of said plurality of pivotal connection means between individual opposing ones of said cam and pump slides, and each one of which contains a slot therein; a plurality of pivotal attaching means; a plurality of coupling means; and a plurality of pivot brackets, each one having an upper end pivotally attached via an individual one of said plurality of pivotal attaching means to a position within the slot of an individual one of said crank levers, and a lower end adjustably coupled via an individual one of said plurality of coupling means to said lower rotary plate.

3. The container filling machine of claim 2, further including means for providing individual adjustment of the stroke of each one of said piston pumps.

4. The container filling machine of claim 3, further including means for providing simultaneous adjustment of the stroke of each one of said piston pumps.

5. The container filling machine of claim 3, wherein said means for providing individual adjustment of the stroke of each one of said piston pumps, includes:

a plurality of adjuster blocks, each one of which is rigidly mounted to the lower end of an individual one of said pivot brackets beneath an ope[illegible] in said lower rotary plate;

a plurality of stroke adjusting screws, each [illegible]ne of which is threadably mated to and through an individual one of said adjuster blocks;

means for turning each one of said plurality of stroke adjusting screws; and a plurality of pairs of bearing means rigidly attached to said lower rotary plate, individual ones of said screws being retained by one of said pairs of bearings, with one end of said screws protruding through its respective bearing means for individual connection to said turning means, and when said protruding end is turned by said turning means, its associated adjuster block moves along said screw for positioning the upper end of said pivot bracket in the slot of said crank lever, for changing the stroke of the associated piston pump.

6. The container filling machine of claim 5, wherein said means for providing simultaneous adjustment of the stroke of each one of said piston pumps further includes:

chain and sprocket means carried by said upper and lower rotary plates, and interconnecting the protruding ends of said stroke adjusting screws, for simultaneously turning said screws in the same direction and to the same degree.

7. The container filling machine of claim 1, wherein said cam controlled pumping means further includes:

a rotatable center column;

an upper rotary plate mounted between said center column and an uppermost portion of said cam;

a lower rotary plate mounted upon said center column below said upper rotary plate;

a plurality of first slide shafts mounted between said upper and lower rotary plates, juxtaposed to said cam, and associated with a particular one of said piston pumps;

a plurality of cam slides, each one of which is both mounted upon an individual one of said first slide shafts, for vertical movement thereupon, and pivotally connected to one end of an individual one of said crank levers; and a plurality of cam followers rigidly mounted one upon each cam slide, each cam follower having a free end protruding into and guided by said track of said cam.

8. The container filling machine of claim 7 wherein said stroke adjusting means further includes:

a plurality of second slide shafts mounted between said upper and lower rotary plates, juxtaposed to said column, and each being associated with a particular one of said piston pumps;

a plurality of pump slides, each one of which is mounted for vertical movement upon an individual one of said second slide shafts, and rigidly connected to a lower end of an individual one of said piston rods; and said means for controlling the pivoting of said plurality of crank levers includes: a plurality of pivotal connection means; said plurality of crank levers each being pivotally connected via an individual one of said plurality of pivotal connection means between individual opposing ones of said cam and pump slides, and each one of which contains a slot therein; a plurality of pivotal attaching means; a plurality of coupling means; and a plurality of pivot brackets, each one having an upper end pivotally attached via an individual one of said plurality of pivotal attaching means to a position within the slot of an individual one of said crank levers, and a lower end adjustably coupled via an individual one of said plurality of coupling means to said lower rotary plate.

9. In a container filling machine, the combination comprising:

an upper horizontal support plate providing an uppermost mounting platform for said filling machine;

a base plate providing a lowermost mounting platform for said filling machine;

a lower horizontal support plate located between said upper support and base plates;

a rotatable center column passing through a hole in said lower horizontal support plate, and mounted for rotation between said upper support and base plates;

sleeve-like means keyed to and slideably mounted upon said center column between said upper horizontal support and base plates;

a plurality of fluid dispensing means arranged in a circle, evenly spaced about, and rigidly coupled to an uppermost portion of said sleeve-like means between said upper and lower support plates;

a lower rotary plate rigidly mounted upon a lowermost portion of said sleeve-like means between said lower support and base plates;

an upper rotary plate rigidly mounted to a portion of said sleeve-like means between said lower support plate and lower rotary plate;

a plurality of cam controlled pumping means rigidly mounted between said upper and lower rotary plates, each one of which provides pumping power to an individual one of said plurality of fluid dispensing means;

a plurality of container elevating platform means each including a container platform located directly below an individual one of said fluid dispensing means above said lower support plate, and rod-like means slideably mounted with and through said upper and lower rotary plates, for controlling the vertical position of said container platforms relative to said fluid dispensing means; and, container height adjusting means located between said lower support and base plates for raising and lowering said upper and lower rotary plates, pumping means, and fluid dispensing means, all in unison while permitting the rotation thereof and without changing the vertical position of said container platforms, for accommodating various sizes of containers.

10. The container filling machine of claim 9, wherein said container height adjusting means includes:

a plurality of jackscrews rotatably mounted between said upper support and base plates:

a plurality of nuts each one of which is threadably mated to an individual one of said jackscrews;

a rotary bearing rigidly mounted upon said nuts for supporting said upper rotary plate at an edge, said upper rotary plate being rotatable upon said rotary bearing; and means mounted upon said jackscrews for turning said jackscrews to move said nuts to a given vertical position.

11. The container filling machine of claim 10, wherein said turning means includes:

a plurality of chain sprockets each one of which is rigidly mounted upon an individual one of said jackscrews at a like vertical position thereupon;

a chain interconnecting said sprockets; and driving means connected to the upper end of one of said plurality of jackscrews, for turning this one jackscrew a given amount in a given direction, thereby causing each one of said jackscrews to be identically turned via said chain, for moving said nuts to a desired vertical position relative to a container height.

12. The container filling machine of claim 11, wherein said driving means is a handwheel.

* * * * *

UNITED STATES PATENT OFFICE

CERTIFICATE OF CORRECTION

Patent No. 4,108,221 Dated August 22, 1978

Inventor(s) Gerhart William Freimuth; Jerold Samuel Weiner

It is certified that error appears in the above-identified patent and that said Letters Patent are hereby corrected as shown below:

Column 1, line 22, change "To" to -- The --.

Column 8, line 15, change "mechanisms" to -- mechanism --.

Column 8, line 30, change "contact" to -- connect --.

In Fig. 9, in "65°" section change "DECELLERATION" to -- DECELERATION--; and in "130°" section change "DECELLERATION" to -- DECELERATION --.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*